US009723928B2

(12) United States Patent
Krishtul

(10) Patent No.: US 9,723,928 B2
(45) Date of Patent: Aug. 8, 2017

(54) SITTING BONES CUSHION

(71) Applicant: Max Krishtul, North Miami Beach, FL (US)

(72) Inventor: Max Krishtul, North Miami Beach, FL (US)

( * ) Notice: Subject to any disclaimer, the term of this patent is extended or adjusted under 35 U.S.C. 154(b) by 0 days.

(21) Appl. No.: 15/177,756

(22) Filed: Jun. 9, 2016

(65) Prior Publication Data

US 2017/0000264 A1 Jan. 5, 2017

Related U.S. Application Data

(63) Continuation-in-part of application No. 29/566,964, filed on Jun. 3, 2016, and a continuation-in-part of application No. 14/808,321, filed on Jul. 24, 2015, which is a continuation-in-part of application No. 29/532,201, filed on Jul. 2, 2015, now Pat. No. Des. 773,212.

(51) Int. Cl.
*A47C 7/18* (2006.01)
*A47C 7/02* (2006.01)

(52) U.S. Cl.
CPC ..... *A47C 7/022* (2013.01); *A47C 7/021* (2013.01); *A47C 7/18* (2013.01)

(58) Field of Classification Search
CPC ..... A47C 7/021; A47C 7/022; A47C 7/18
USPC ..... 297/219.1, 452.23, 452.24, 452.25, 297/452.26; 5/653
See application file for complete search history.

(56) References Cited

U.S. PATENT DOCUMENTS 604,347 A * 5/1898 Bray ..... B62J 1/005 297/201
2,384,713 A * 9/1945 Varma ..... B60N 2/7005 297/452.26
2,819,712 A * 1/1958 Morrison ..... A47C 4/54 5/655.3 X
2,933,738 A * 4/1960 Whelan ..... A47C 20/027 5/630
3,158,878 A * 12/1964 Pernell ..... A61G 7/05723 5/653 X
3,531,157 A * 9/1970 Duckett ..... A47C 1/12 297/452.25 X (Continued)

OTHER PUBLICATIONS iCoudy, iCoudy-Memory-Cushion-Sciatica-Prostate, Internet, Mar. 11, 2016, 1 page, Amazon, https://www.amazon.com/iCoudy-Memory-Cushion-Sciatica-Prostate/dp/B01A80DJ68.

(Continued)

*Primary Examiner* — Rodney B White
(74) *Attorney, Agent, or Firm* — IDP Patent Services; Olav M. Underdal

(57) ABSTRACT

A sitting bones cushion can include a right aperture and a left aperture, which can allow a person sitting on the cushion to experience reduced pressure on the person's lower pelvis. The sitting bones cushion can also include a right leg support cutout, a left leg support cutout, and a rear cutout, which can allow a person sitting in the cushion to experience reduced pressure on the person's coccyx, while having support and guidance to the position of the legs. The features of the cushion may promote a healthy sitting posture, proper spine alignment, and may reduce or prevent pain in the lower back and buttocks. Also disclosed is a method for configuring a support contour of a cushion.

18 Claims, 12 Drawing Sheets

Toroidal Seat Cushion

Sitting Bones Cushion

(56) References Cited

U.S. PATENT DOCUMENTS

| | | | | | |
|---|---|---|---|---|---|
| 3,987,507 | A * | 10/1976 | Hall | A47C 7/18 | 5/653 X |
| 4,660,238 | A | 4/1987 | Jay | | |
| 4,682,818 | A * | 7/1987 | Morell | A47C 27/148 | 5/653 X |
| 4,753,480 | A * | 6/1988 | Morell | A47C 7/022 | 5/653 X |
| 4,781,417 | A * | 11/1988 | Shipman | B60N 2/686 | 297/452.24 |
| 5,034,594 | A | 7/1991 | Beezhold et al. | | |
| 5,105,489 | A * | 4/1992 | Meyer | A61F 5/01 | 297/452.23 |
| 5,414,884 | A * | 5/1995 | Mackenzie | A47C 7/022 | 297/452.23 X |
| 5,702,153 | A | 12/1997 | Pliska | | |
| 5,833,319 | A * | 11/1998 | Davis | A47C 7/425 | 297/452.23 X |
| 5,979,975 | A | 11/1999 | Hiraoka | | |
| 6,012,188 | A | 1/2000 | Daniels et al. | | |
| 6,082,824 | A * | 7/2000 | Chow | A47C 7/022 | 297/452.24 X |
| 7,140,057 | B2 * | 11/2006 | Hetzel | A47C 7/022 | 297/452.26 |
| 7,216,388 | B2 * | 5/2007 | Bieganek | A47C 7/022 | 297/452.26 |
| 7,225,486 | B2 | 6/2007 | Jackson | | |
| 7,373,678 | B2 * | 5/2008 | Hetzel | A47C 7/022 | 297/452.26 X |
| 7,614,704 | B2 * | 11/2009 | Whelan | A47C 7/021 | 297/452.25 |
| 8,291,535 | B2 | 10/2012 | Kemper | | |
| 8,696,059 | B2 | 4/2014 | Carmichael | | |
| 8,919,885 | B2 * | 12/2014 | Han | A47C 4/02 | 297/452.24 X |
| D748,421 | S * | 2/2016 | Warner | D6/349 | |
| 9,609,950 | B2 * | 4/2017 | Covelli | A47C 7/021 | |
| 2002/0175553 | A1 * | 11/2002 | Steifensand | A47C 3/00 | 297/452.22 |
| 2006/0103225 | A1 | 5/2006 | Kim | | |
| 2006/0150336 | A1 | 7/2006 | Jackson | | |
| 2007/0236074 | A1 | 10/2007 | Rodriquez | | |
| 2008/0216245 | A1 | 9/2008 | Liners | | |
| 2009/0295203 | A1 * | 12/2009 | Lewis | A61G 5/1043 | 297/219.1 |
| 2012/0068507 | A1 * | 3/2012 | Debevec | A47C 7/021 | 297/250.1 |
| 2016/0113401 | A1 * | 4/2016 | Covelli | A47C 7/14 | 297/452.48 |
| 2017/0099953 | A1 * | 4/2017 | Harte | A47C 7/744 | |
| 2017/0136294 | A1 * | 5/2017 | Piksa | A63B 23/02 | |

OTHER PUBLICATIONS

Independent Living, DOAbility, Keyhole Comfort Cushion, retrieved Jul. 8, 2016. 1 page, Internet, retrieved from Internet Web Archives, Mar. 9, 2015, http://web.archive.org/web/20150309092525/http://www.independentliving.com.au/store/Cushions+and+Back+Rests/Keyhole+Comfort+Cushion.

* cited by examiner

Toroidal Seat Cushion

Sitting Bones Cushion

Sitting Bones Cushion

SITTING BONES CUSHION

CROSS-REFERENCE TO RELATED APPLICATIONS

This application is a continuation-in-part of U.S. Design application Ser. No. 29/566,964 filed Jun. 3, 2016, and a continuation-in-part of U.S. Non-Provisional application Ser. No. 14/808,321 filed Jul. 24, 2015, which is a continuation-in-part of U.S. Design application Ser. No. 29/532,201 filed Jul. 2, 2015.

FIELD OF THE INVENTION

The present invention relates generally to the field of seat cushions, and more specifically to seat cushions that allows persons having discomfort of the sitting bones of the body to sit more comfortably.

BACKGROUND OF THE INVENTION

A seat cushion aims to provide a comfortable seating experience. Seat cushions can either be designed for permanent position in a chair or be designed for portable use in different seating situation, such as for example in different chairs, car seats, and wheelchairs.

Contoured cushions are well known in the art for increasing the comfort of a person in the seated position. Running and prolonged sitting on a hard surface can lead to damage to the ischial tuberosities of the lower pelvis, which can result in ischial bursitis. There are several well-known variants of cushions designed for reducing pressure to the tailbone, in addition to assisting in the relief of pain and pressure due to hemorrhoids, rectal surgery and episiotomy. However, existing cushion designs generally are not designed for people suffering from ischial bursitis, which causes painful inflammation of ischial tuberosities, or sitting bones, and renders sitting on conventional cushions impractical.

As such, considering the foregoing, it may be appreciated that there continues to be a need for novel and improved devices and methods for contoured cushions designed for reducing pressure on the sitting bones of the buttocks.

SUMMARY OF THE INVENTION

The foregoing needs are met, to a great extent, by the present invention, wherein in aspects of this invention, enhancements are provided to the existing model of seat cushions.

In an aspect, a sitting bones cushion can include right and left apertures, which can be in the shape of an elongated ellipsoid, allowing the seat cushion to relieve pressure to the ischial tuberosities, or sitting bones (the two terms are referenced herein synonymously), of a person seated in the cushion.

In a related aspect, the sitting bones cushion can have an top surface and a bottom surface, where the top surface can be configured at an angle of inclination relative to the bottom surface in the range of 1 to 45 degrees.

In a related aspect, the sitting bones cushion can include a right leg support cutout, and a left leg support cutout, where both leg support cutouts run parallel to the sides, substantially in the middle between the sides and the centerline of the cushion. The leg support cutouts serve to support, guide, and position the legs of a person seated in the cushion.

In related aspects, the leg support cutouts can have various degrees of negative or positive slant, or a slant of substantially zero.

In a related aspect, the sitting bones cushion can further include a rear cutout, which serves to reduce any pressure on the coccyx or central buttock area of a person seated in the cushion.

In a related aspect, the sitting bones cushion can be manufactured with an inner core of high-resilience upholstery foam.

In a related aspect, the seat cushion can further include a cushion cover, which can be configured to be removable.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
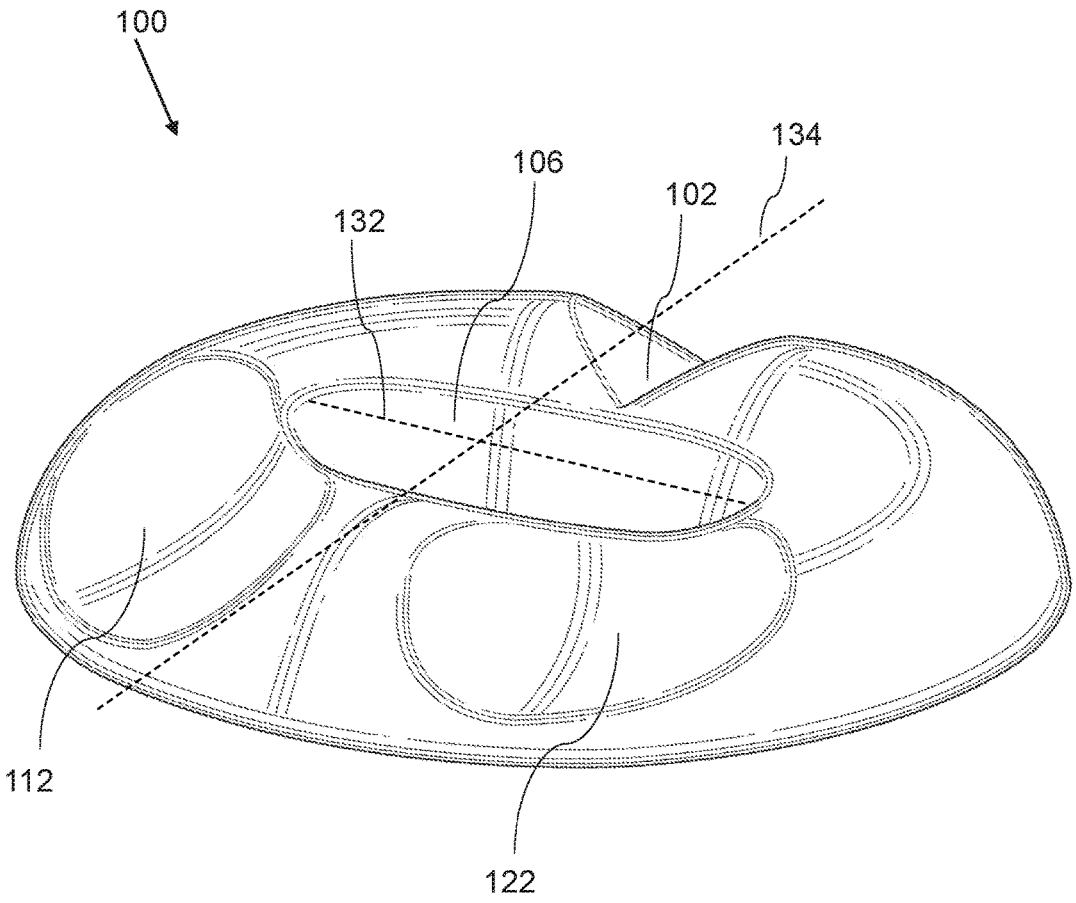
FIG. 1 is a top perspective view of a toroidal seat cushion, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a cushion with reference to FIG. 1, in such manner that like reference numerals refer to like components throughout; a convention that we shall employ for the remainder of this specification.

In an embodiment, as shown in FIG. 1, a toroidal seat cushion 100, which is ring-torus shaped, can comprise:

a) a central aperture 106, which can be in the shape of an elongated ellipsoid, such that an elongated center axis 132 of the central aperture 106 is perpendicular to a front to rear centerline 134 of the toroidal seat cushion, whereby a person when seated in a standard position can reduce pressure on the person's central buttocks area;

b) a rear cutout 102, which is positioned on an upper rear part of the toroidal seat cushion 100, such that it is configured with a shape, which is left-right reflection symmetrical with respect to the front to rear centerline 134, whereby a person when seated in a standard position can reduce pressure on the person's coccyx;

c) a right leg support cutout 112, which is positioned on an upper front right part of the toroidal seat cushion 100, such that the right leg support cutout 112 is configured to support, guide, and position a right leg of a person seated on the toroidal seat cushion 100 in a conventional position;

d) a left leg support cutout 122, which is positioned on an upper front left part of the toroidal seat cushion 100, such that the left leg support cutout 122 is configured with a shape, which is symmetrical with a shape of the right leg support cutout 112, with respect to the front to rear centerline 134, such that the left leg support cutout 122 is configured to support, guide, and position a left leg of a person seated on the toroidal seat cushion 100 in a conventional seating position;

whereby the toroidal seat cushion 100 stabilizes a seating position of a user, thereby providing relief from pressure and pain to the tail bone, lower back and central buttocks.

Figure 2:
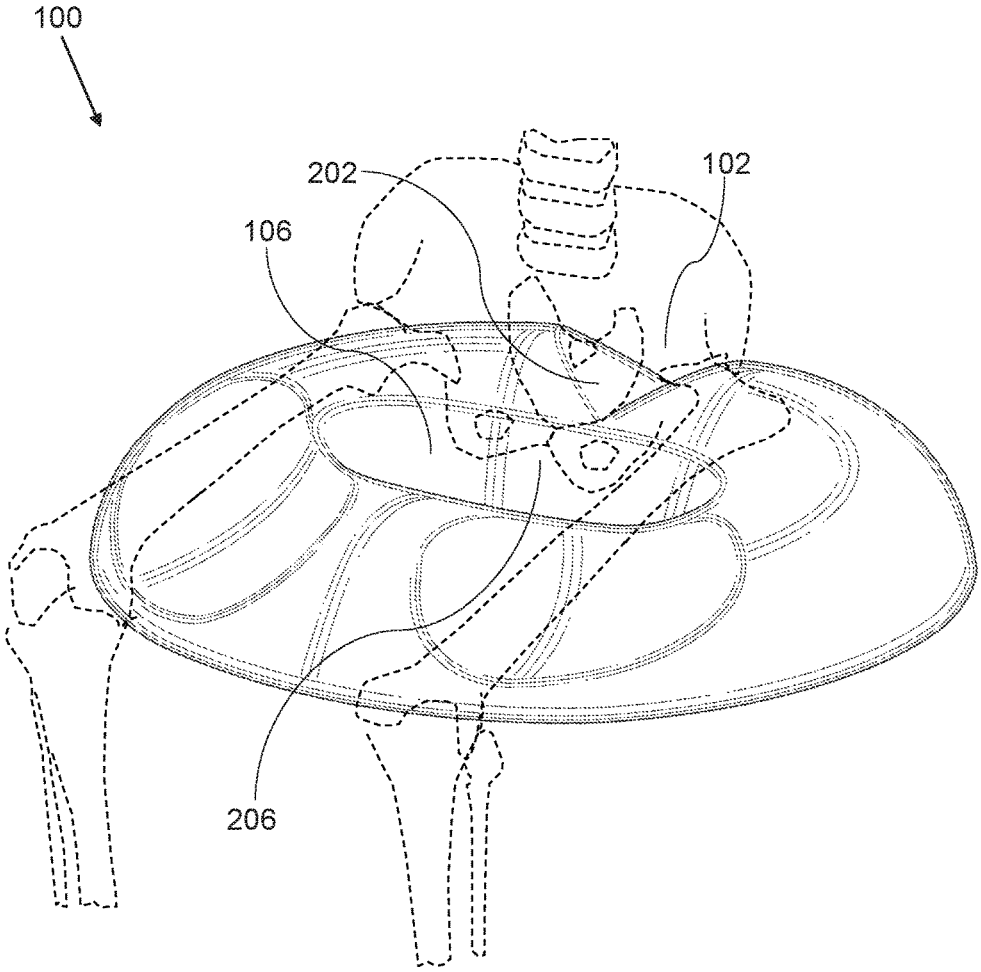
FIG. 2 is a top perspective view of a toroidal seat cushion, illustrating by superimposition the approximate seating position and support of a person's skeletal structure, according to an embodiment of the invention.

In an embodiment, FIG. 2 shows the same view as FIG. 1, and illustrates by superimposition the approximate seating position and support of a person's skeletal structure, shown in dotted lines, when seated in a conventional seating position, illustrating how the central aperture 106 alleviates pressure to the central buttocks area 206 of the user and the rear cutout 102 alleviates pressure to the coccyx area 202 of the user.

Figure 3:
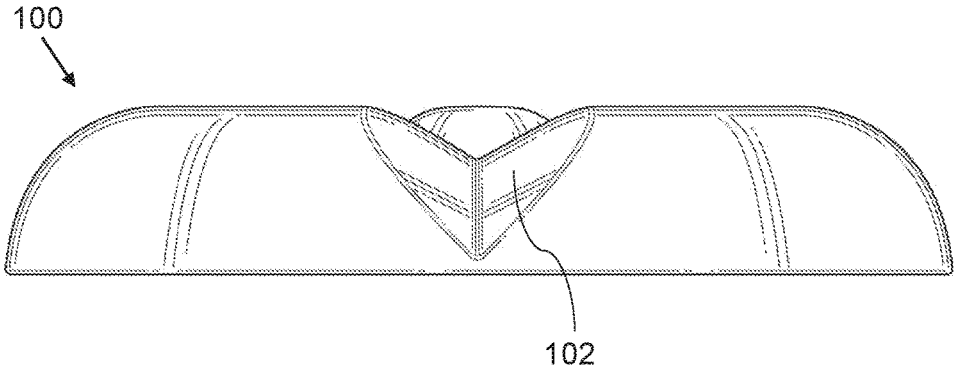
FIG. 3 is a rear view of a toroidal seat cushion, according to an embodiment of the invention.
Figure 4:
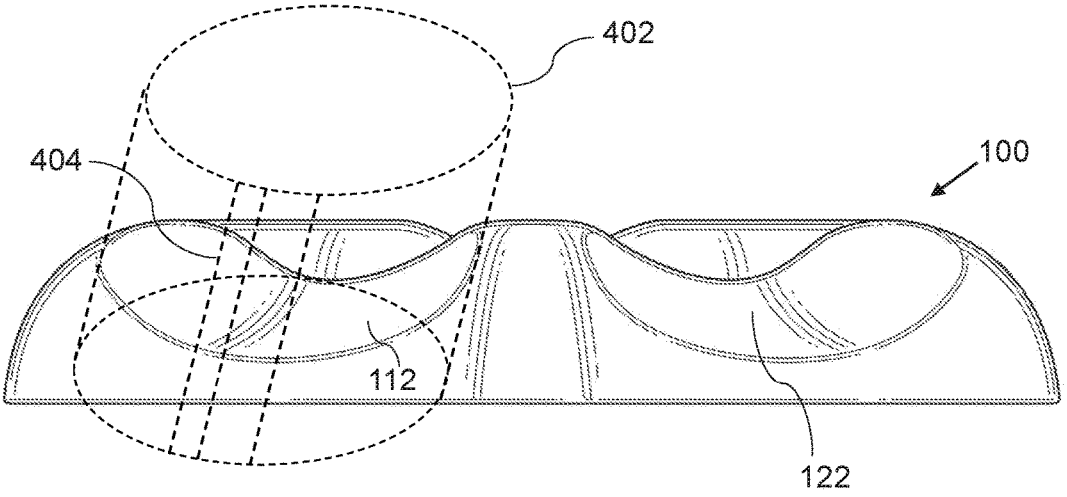
FIG. 4 is a front view of a toroidal seat cushion, according to an embodiment of the invention.

In an embodiment, FIGS. 3 and 4, show respectively a rear and front view of the toroidal seat cushion 100.

In an embodiment, surfaces of the right and left leg support cutouts 112 122 can be concave.

In an embodiment, surfaces of the right and left leg support cutouts 112 122 can be shaped as an inner segment of a sphere, which is concave.

In an embodiment, surfaces of the right and left leg support cutouts 112 122 can be shaped as an inner segment of an ellipsoid, which is concave.

In an embodiment, cutout surfaces of the right and left leg support cutouts 112 122 can be shaped as an inner segment of a circular cylinder, whereby surface lines following the elongated direction of the cylinder are straight and all other surface lines are concave.

In an embodiment, such as shown in FIG. 4, surfaces of the right and left leg support cutouts 112 122 can each be shaped as an inner segment of an elliptic cylinder 402, such that surface lines 404, following the elongated direction of the elliptic cylinder 402 are straight and all other surface lines are concave, such that the straight surface lines can have an outward angle and a downward inclination angle.

In a related embodiment, surfaces of the right and left leg support cutouts 112 122 can each be shaped as an inner segment of a general cylinder, which includes elliptic, circular, parabolic, and hyperbolic cylinders, and cylinders of other shapes, such that surface lines 404, following the elongated direction of the general cylinder 402 are straight and all other surface lines are concave, such that the straight surface lines can have an outward angle and a downward inclination angle.

Figure 5:
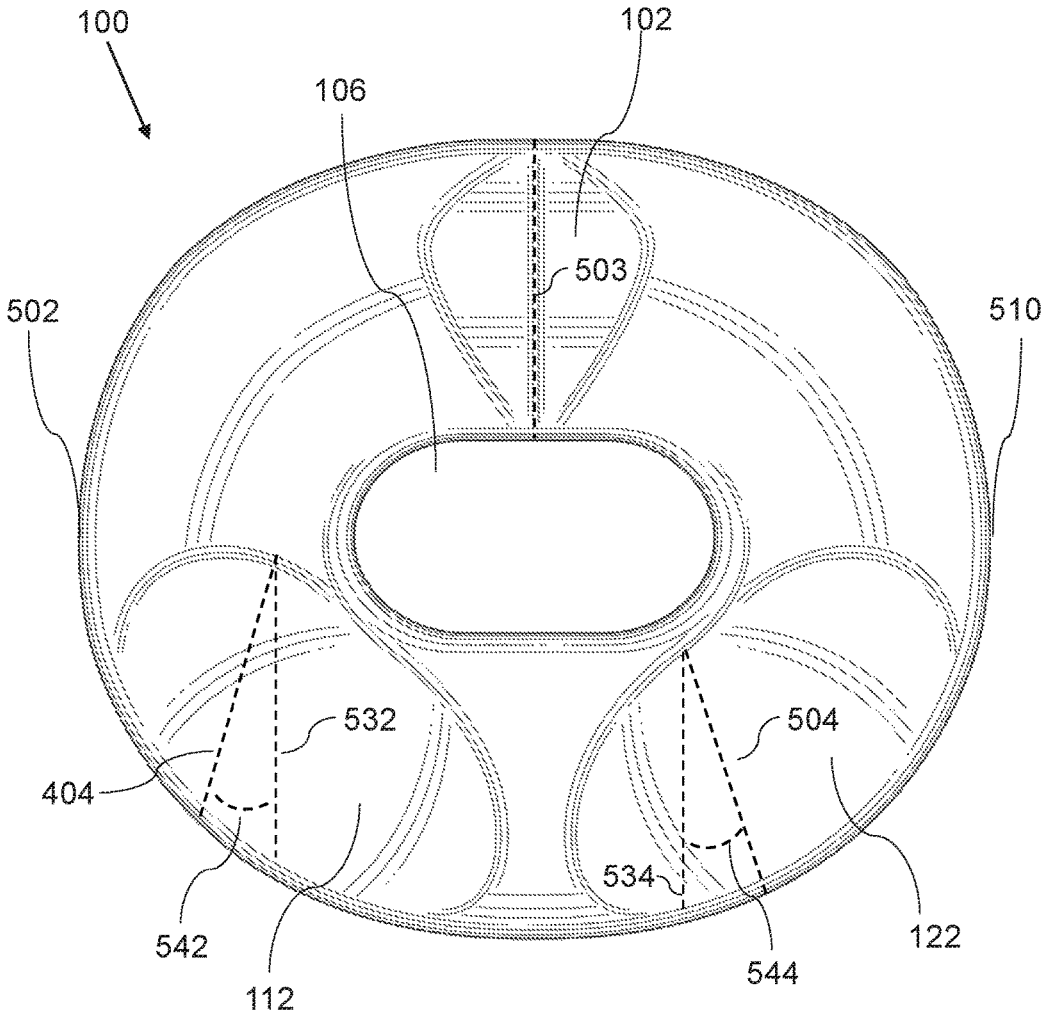
FIG. 5 is a top view of a toroidal seat cushion, according to an embodiment of the invention.

In a further related embodiment, FIG. 5 illustrates the outward angle of surface lines, as respectively:

a) a right outward angle 542 of a straight surface line 404 of the right cutout 112, relative to the centerline 134, or as here shown, a line 532 parallel to the centerline 134; and b) a left outward angle 544 of a straight surface line 504 of the right cutout 112, relative to the centerline 134, or as here shown, a line 534 parallel to the centerline 134.

In a related embodiment, the right and left outward angles 542 544 can each be configured in a range of 1 to 45 degrees.

In an embodiment, FIG. 5, shows a top view of the toroidal seat cushion 100, further illustrating by superimposed dotted lines:

a) the right side of the cushion 502;

b) the left side of the cushion 510;

c) the rear cutout centerline 503, which is a lowest point line of the rear cutout 102.

Figure 6:
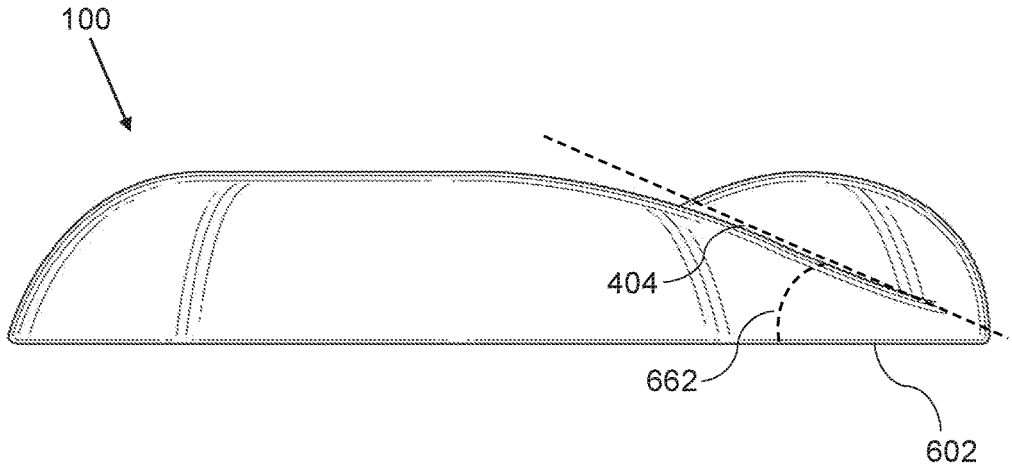
FIG. 6 is a side view of a toroidal seat cushion, according to an embodiment of the invention.

In a further related embodiment, FIG. 6 illustrates the right or left downward inclination angle 662 of respectively a right or left surface line 404, relative to a horizontal plane of an underside 602 of the toroidal seat cushion 100

In a related embodiment, the right and left downward inclination angles 662 can each be in a range of 1 to 45 degrees.

In a further related embodiment, the cushion cover can be removable, via well-known methods, such as for example a zip on the front underside of the cover.

In related embodiments, the toroidal seat cushion 100 can:

a) add comfort to a chair, bench, car seat, plane seat, floor, wheelchair, or other seating surface;

b) reduce, alleviate, prevent or eliminate back pain by reducing body weight pressure on the coccyx and central buttocks, via the central aperture 106 and the rear cutout 102;

c) promote a healthy sitting posture, proper spine alignment, superior comfort; and d) reduce, alleviate, prevent or eliminate pressure ulcers.

Figure 7:
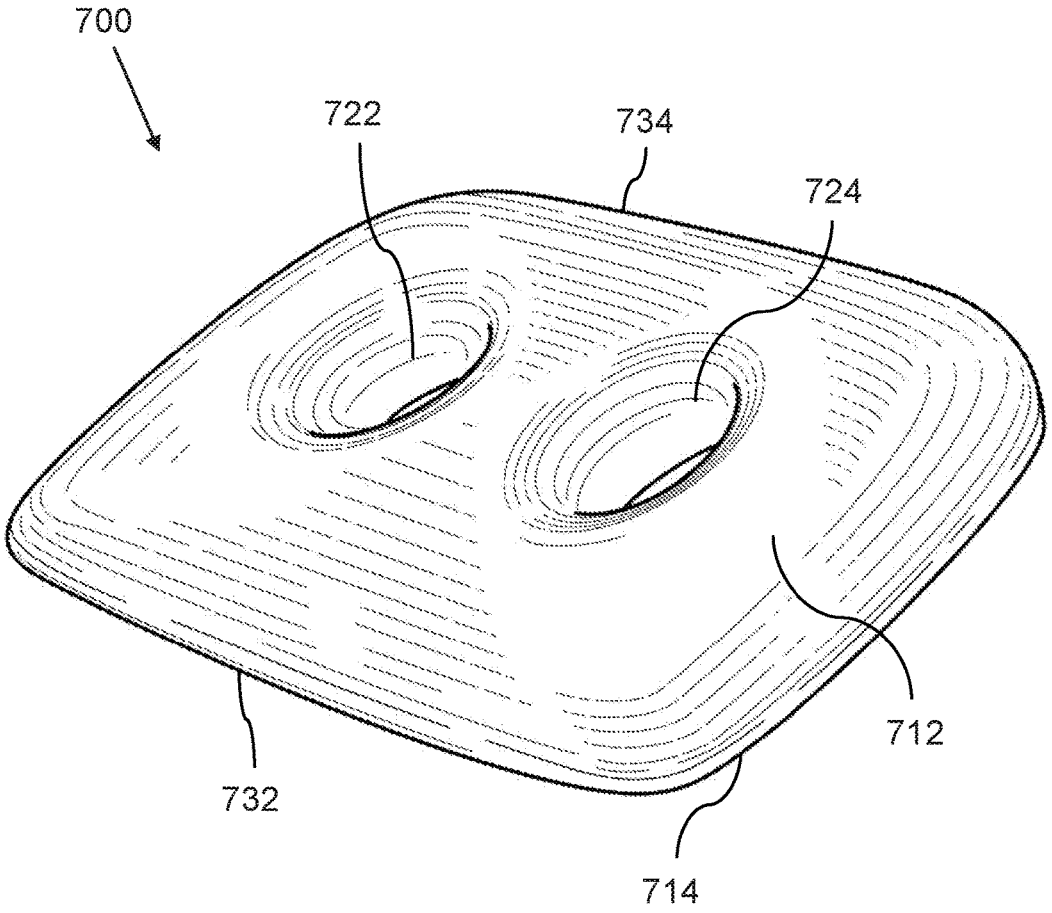
FIG. 7 is a top perspective view of a sitting bones cushion, according to an embodiment of the invention.

A method of configuring a support contour or shape of a cushion to promote a healthy sitting posture, can comprise:

a) configuring a cushion with a ring-torus shape and a central aperture, such that a user's weight is supported by the upper cushion surface whereas the center is substantially weightless when a person is seated in the cushion, thus reducing pain and pressure to the lower back and central buttocks;

b) defining leg support areas, which can be contoured cutouts to position, guide and support the legs;

c) making a cutout in the rear area of the cushion, which can ensure that there is reduced pressure on the lower back and central buttocks of a person seated in the cushion;

In an embodiment, as shown in FIG. 7, a sitting bones cushion 700 can comprise:

a) a right aperture 722, which can be configured to receive a right sitting bone of a user that is seated on the sitting bones cushion 700, such that the right aperture 722 can extend between a top surface 712 and a bottom surface 714 (as indicated in FIG. 7, and shown fully in FIG. 10) of the sitting bones cushion 700; and b) a left aperture 724, which can be configured with a shape, which can be symmetrical with a shape of the right aperture 722, with respect to a front to rear centerline of the sitting bones cushion 700, wherein the left aperture 724 can be configured to receive a left sitting bone of the user that is seated on the sitting bones cushion 700, such that the left aperture 724 can extend between the top surface 712 and the bottom surface 714 of the sitting bones cushion 700;

wherein the right and left apertures 722 724 can be configured to reduce the pressure applied to the right and left sitting bones when the user is seated on the sitting bones cushion 700, thereby providing relief from pressure and pain to the buttocks of the user.

In a further related embodiment, as shown in FIG. 7, the sitting bones cushion can include a top surface 712 and an opposing bottom surface 714. The sitting bones cushion 700 can further include a front edge 732 and a back edge 734.

Figure 8:
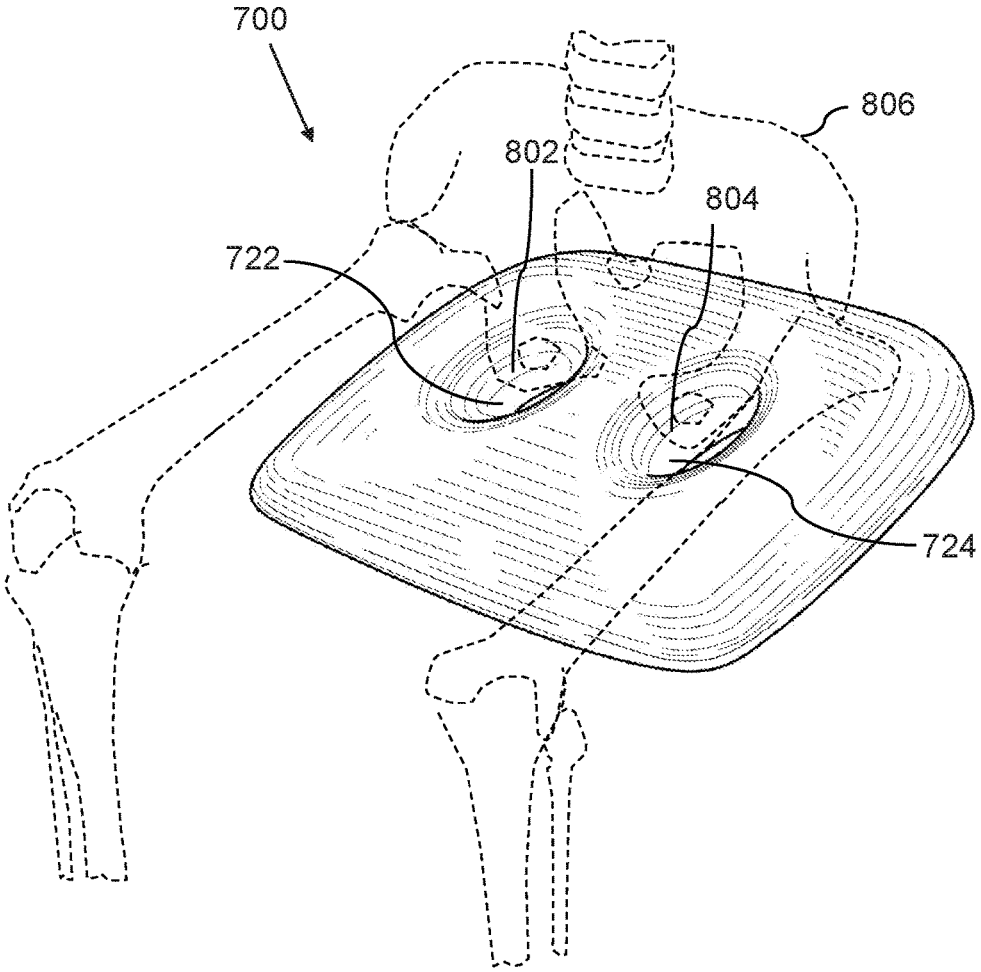
FIG. 8 is a top perspective view of a sitting bones cushion, illustrating by superimposition the approximate seating position and support of a person's skeletal structure, according to an embodiment of the invention.

In a related embodiment, FIG. 8 shows the same view as FIG. 7, and illustrates by superimposition the approximate seating position and support of a person's skeletal structure, shown in dotted lines, when seated in a conventional seating position, illustrating how the right and left apertures 722 724 can be configured to receive the respective right and left ischial tuberosities 802 804 of the lower part of the pelvis 806, thereby alleviating pressure to the right and left ischial tuberosities 802 804. The ischial tuberosities 802 804 can also be referred to as the sitting bones 802 804. The reduced pressure to the sitting bones 802 804 offered by the sitting bones cushion 700 allows a person suffering from ailments such as ischial bursitis to be seated comfortably in the cushion 700.

Figure 9:
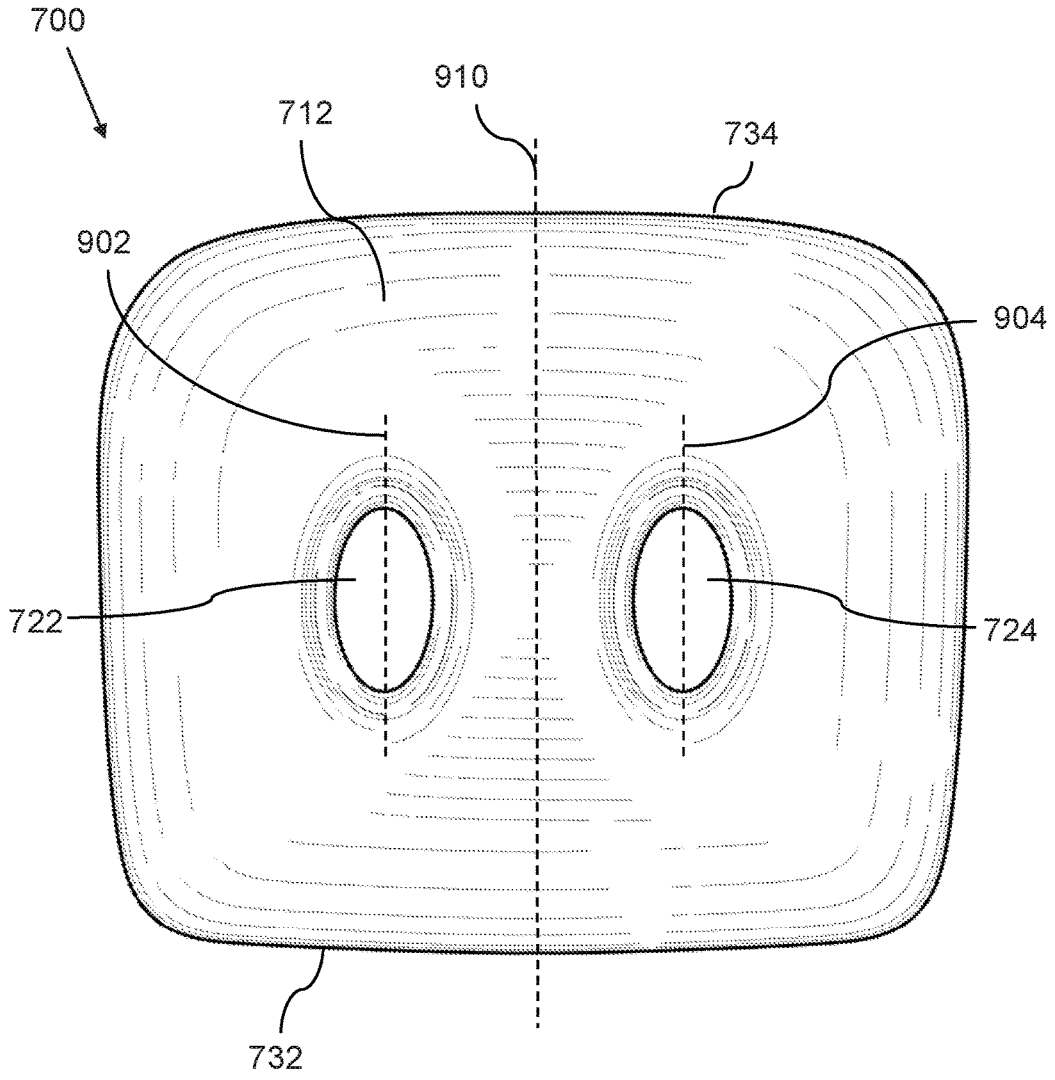
FIG. 9 is a top view of a sitting bones cushion, according to an embodiment of the invention.

In a related embodiment, FIG. 9 shows a top view of the sitting bones cushion 700. The right and left apertures 722 724 can each be shaped as ellipses. Furthermore, the right and left apertures 722 724 can be configured such that the elongated center axes 902 904 of the right and left apertures 722 724, respectively, are parallel to a front to rear centerline 910 of the sitting bones cushion 700. In other embodiments, right and left apertures 722 724 can be configured as other shapes, such as circles, squares, rectangles, or any other suitable shape.

In a further related embodiment, as shown in FIG. 9, the sitting bones cushion 700 can be configured with rounded outer corners, designed to increase the comfort provided by the sitting bones cushion 700 and to give the cushion 700 a rounded and comfortable appearance.

Figure 10:
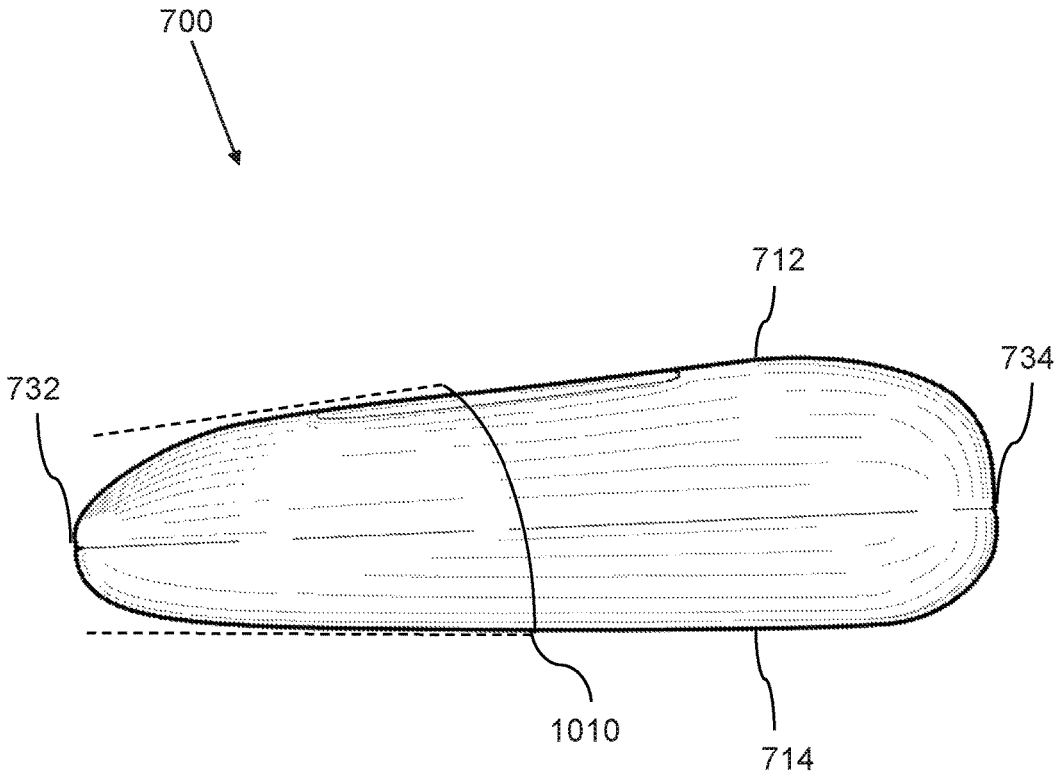
FIG. 10 is a side view of a sitting bones cushion, according to an embodiment of the invention.

In a related embodiment, as shown in FIG. 10, the top surface 712 can be tilted upward at an inclination angle 1010 relative to the bottom surface 714, as measured from the front edge 732 to the back edge 734. Furthermore, the sitting bones cushion 700 can be configured such that, when the cushion 700 is placed on a flat, level surface, the top surface 712 can be oriented at an inclination angle 1010 relative to horizontal. The sitting bones cushion 700 can be configured such that the inclination angle 1010 is generally in the range of 1 to 45 degrees.

In a further related embodiment, the top surface 712 can be tilted downward as measured from the front edge 732 to the back edge 734, such that the inclination angle 1010 is measured from the back edge 734 to the front edge 732. In certain embodiments, the inclination angle 1010 can be 0 degrees, such that the top surface 712 is parallel with the bottom surface 714.

Figure 11:
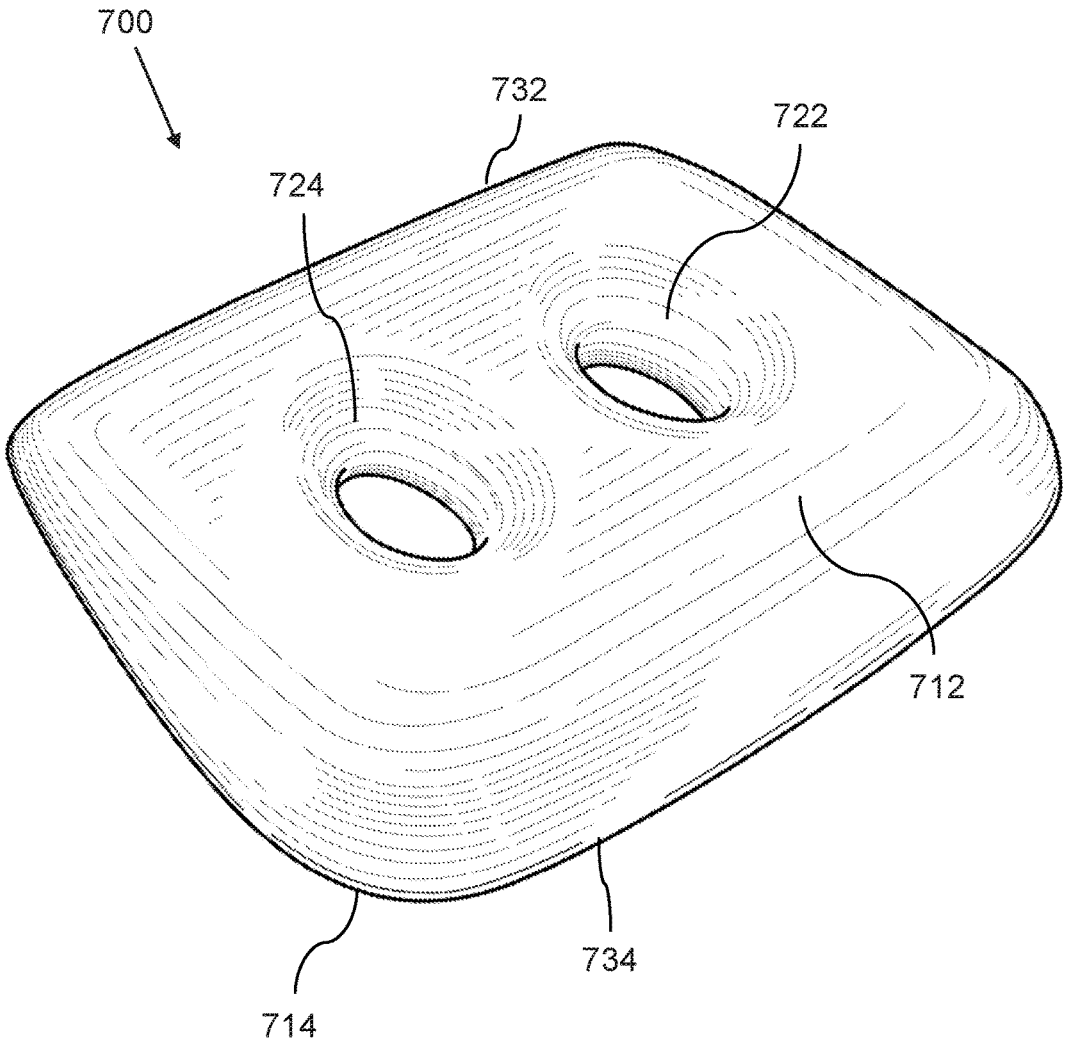
FIG. 11 is a top perspective view of a sitting bones cushion, according to an embodiment of the invention.

In a related embodiment, FIG. 11 shows a top perspective view of the sitting bones cushion 700. In certain embodiments, the sitting bones cushion 700 can include a zipper (not shown) located near the back edge 734. The zipper can be configured to allow the cover of the sitting bones cushion 700 to be removable. In certain embodiments, the zipper can be located elsewhere on the sitting bones cushion 700, such as the front underside of the cover. In other embodiments, the sitting bones cushion 700 can include other zippers, such as zippers located near the apertures 722 724, which can be operated along with the zipper to allow the cover of the cushion 700 to be removed.

Figure 12:
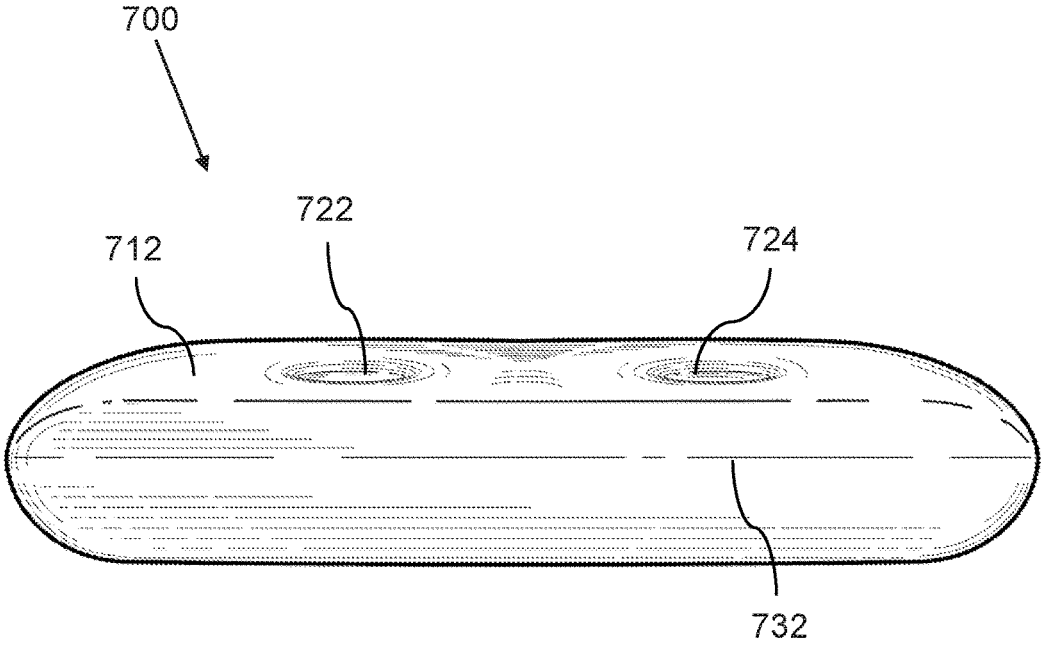
FIG. 12 is a front view of a sitting bones cushion, according to an embodiment of the invention.

In a related embodiment, FIG. 12 shows a front view of the sitting bones cushion 700. The top surface 712 can be configured as a substantially flat surface extending around and between the right and left apertures 722 724.

In related embodiments, the sitting bones cushion 700 can:

a) add comfort to a chair, bench, car seat, plane seat, floor, wheelchair, or other seating surface;

b) reduce, alleviate, prevent or eliminate back and buttock pain by reducing body weight pressure on the sitting bones, via the right and left apertures 722 724;

c) promote a healthy sitting posture, proper spine alignment, superior comfort; and d) reduce, alleviate, prevent or eliminate pressure ulcers.

A method of configuring a support contour or shape of a cushion to promote a healthy sitting posture can comprise configuring a cushion 700 with a left aperture 724 and a right aperture 722, such that a user's weight is supported by an upper surface 712 of the cushion 700, wherein the right and left apertures 722 724 are configured to reduce the pressure applied to respective right and left sitting bones of a user seated on the cushion 700, thus reducing pain to the buttocks.

Figure 13:
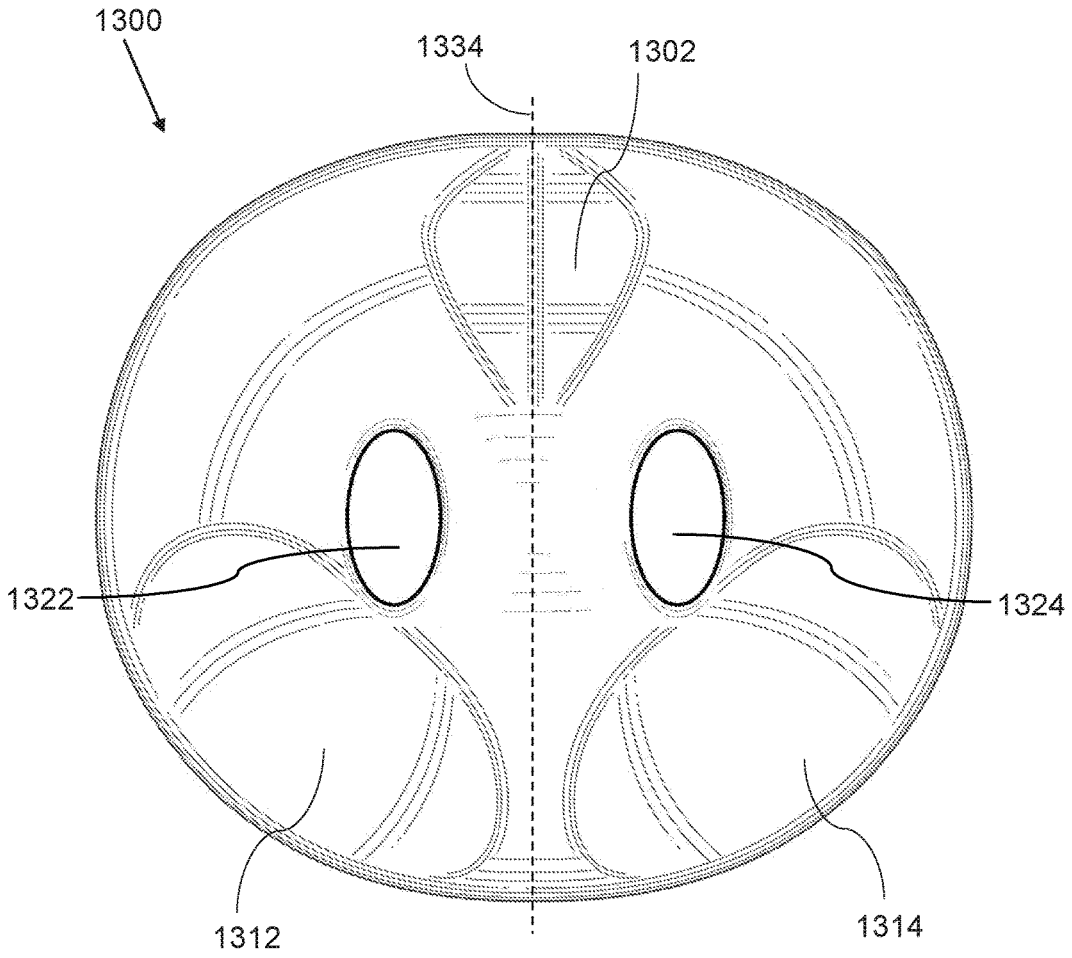
FIG. 13 is a top view of a sitting bones cushion, according to an embodiment of the invention.

In an embodiment, as shown in FIG. 13, a sitting bones cushion 1300 can comprise:

a) a rear cutout 1302, which is positioned on an upper rear part of the sitting bones cushion 1300, such that it is configured with a shape, which is left-right reflection symmetrical with respect to the front to rear centerline 1334, whereby a person when seated in a standard position can reduce pressure on the person's coccyx;

b) a right leg support cutout 1312, which is positioned on an upper front right part of the sitting bones cushion 1300, such that the right leg support cutout 1312 is configured to support, guide, and position a right leg of a person seated on the sitting bones cushion 1300 in a conventional position;

c) a left leg support cutout 1314, which is positioned on an upper front left part of the sitting bones cushion 1300, such that the left leg support cutout 1314 is configured with a shape, which is symmetrical with a shape of the right leg support cutout 1312, with respect to the front to rear centerline 1334, such that the left leg support cutout 1314 is configured to support, guide, and position a left leg of a person seated on the sitting bones cushion 1300 in a conventional seating position;

d) a right aperture 1322, which can be configured to receive a right sitting bone of a user that is seated on the sitting bones cushion 1300; and e) a left aperture 1324, which can be configured with a shape, which can be symmetrical with a shape of the right aperture 1322, with respect to a front to rear centerline 1334 of the sitting bones cushion 1300, wherein the left aperture 1324 can be configured to receive a left sitting bone of the user that is seated on the sitting bones cushion 1300;

wherein the right and left apertures 1322 1324 can be configured to reduce the pressure applied to the right and left sitting bones when the user is seated on the sitting bones cushion 1300;

whereby the sitting bones cushion 1300 stabilizes a seating position of a user, thereby providing relief from pressure and pain to the tail bone, lower back and buttocks, thereby providing relief from pressure and pain to the buttocks of the user.

In a related embodiment, the rear cutout 1302, the right leg support cutout 1312, and the left leg support cutout 1314 can be configured similarly to the rear cutout 102, the right leg support cutout 112, and the left leg support cutout 122, respectively, and the right aperture 1322 and the left aperture 1324 can be configured similarly to the right aperture 722 and the left aperture 724, respectively, such that the sitting bones cushion 1300 functions as a combination of the toroidal seat cushion 100 and the sitting bones cushion 700.

In an embodiment, the toroidal seat cushion 100, the sitting bones cushion 700, and the sitting bones cushion 1300 can be manufactured with an inner core made of a high-resilience upholstery foam, such as for example an open or closed cell flexible polyurethane foam with a density in a range from 20 to 60 kg/m3, whereby the upholstery foam can provide softness to underlying hard surfaces so that sitting can become more comfortable.

In a related embodiment, the upholstery foam can be sufficiently high-resilience and of sufficient density to not flatten out during use, and always regain its shape after use.

In further related embodiments, the toroidal seat cushion 100, sitting bones cushion 700, and sitting bones cushion 1300 can be manufactured with an inner core made of other suitable cushioning or upholstery materials, such as gel, memory foam, viscoelastic polyurethane foam, etc.

In a related embodiment, the inner core of the toroidal seat cushion 100, sitting bones cushion 700, and sitting bones cushion 1300 can be covered with a cushion cover, which can be made of common cushion cover materials, such as different fabrics, including velour, natural leather, suede, microfiber fabrics, synthetic leather or suede, etc.

The many features and advantages of the invention are apparent from the detailed specification, and thus, it is intended by the appended claims to cover all such features and advantages of the invention, which fall within the true spirit and scope of the invention.

Consequently, the various embodiments of the invention described herein are multifold and can be manifested in a large plurality of different cushion designs and shapes.

Many such alternative configurations and shapes are readily apparent, and should be considered to be fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A sitting bones cushion, comprising:

a) a right aperture, which is configured to receive a right sitting bone of a user that is seated on the sitting bones cushion;

b) a left aperture, which is configured to receive a left sitting bone of the user that is seated on the sitting bones cushion;

c) a right leg support cutout, which is positioned on an upper front right part of the sitting bones cushion, such that the right leg support cutout is configured to support, guide, and position a right leg of the user that is seated on the sitting bones cushion; and d) a left leg support cutout, which is positioned on an upper front left part of the sitting bones cushion, such that the left leg support cutout is configured with a shape, which is symmetrical with a shape of the right leg support cutout, with respect to a front to rear centerline of the sitting bones cushion, such that the left leg support is configured to support, guide, and position a left leg of the user that is seated on the sitting bones cushion;

wherein the right and left apertures are each configured to extend between a top surface and a bottom surface of the sitting bones cushion;

wherein the right and left apertures are configured to reduce the pressure applied to the right and left sitting bones when the user is seated on the sitting bones cushion, thereby providing relief from pressure and pain to the buttocks of the user;

wherein surfaces of the right and left leg support cutouts are each configured with a shape as an inner segment of an elliptic cylinder, whereby surface lines following an elongated direction of the elliptic cylinder are straight surface lines;

wherein the straight surface lines comprise right and left straight surface lines of respectively the right and left cutouts;

such that the right straight surface lines are configured with a right outward angle in a range of 1 to 45 degrees, relative to the front to rear centerline of the sitting bones cushion; and such that the left straight surface lines are configured with a left outward angle in a range of 1 to 45 degrees, relative to the front to rear centerline of the sitting bones cushion.

2. The sitting bones cushion of claim 1, wherein the right and left apertures are configured to be symmetrical with respect to a front to rear centerline of the sitting bones cushion.

3. The sitting bones cushion of claim 1, wherein the right and left apertures are configured in the shape of an elongated ellipsoid, such that an elongated center axis of each of the right and left apertures is parallel to a front to rear centerline of the sitting bones cushion.

4. The sitting bones cushion of claim 1, wherein the top surface of the sitting bones cushion is oriented at an inclination angle in a range of 1 to 45 degrees, relative to the bottom surface of the sitting bones cushion.

5. The sitting bones cushion of claim 1, wherein an inner core of the sitting bones cushion is made of open cell flexible polyurethane foam with a density in a range from 20 to 60 $kg/m^3$.

6. The sitting bones cushion of claim 1, further comprising a cushion cover, which covers the sitting bones cushion.

7. The sitting bones cushion of claim 6, wherein the cushion cover is removable.

8. The sitting bones cushion of claim 1, further comprising a rear-cutout, whereby the user experiences reduced pressure on a coccyx of the user, when seated in the cushion.

9. The sitting bones cushion of claim 1, wherein surfaces of the right and left leg support cutouts are concave.

10. The sitting bones cushion of claim 9, wherein the surfaces of the right and left leg support cutouts are each configured with a shape as an inner segment of a sphere.

11. The sitting bones cushion of claim 9, wherein the surfaces of the right and left leg support cutouts are each configured with a shape as an inner segment of an ellipsoid.

12. The sitting bones cushion of claim 1, wherein surfaces of the right and left leg support cutouts are each configured with a shape as an inner segment of a circular cylinder, whereby surface lines following an elongated direction of the circular cylinder are straight surface lines.

13. The sitting bones cushion of claim 1, wherein the right straight surface lines are configured with a right downward inclination angle in a range of 1 to 45 degrees, relative to a horizontal plane of an underside of the sitting bones cushion; and the left straight surface lines are configured with a left downward inclination angle in a range of 1 to 45 degrees, relative to the horizontal plane of the underside of the sitting bones cushion.

14. A method of configuring a support contour of a cushion to promote a healthy and comfortable sitting position, comprising:

configuring a cushion with a right aperture and a left aperture, such that a user's weight is supported by an upper surface of the cushion;

defining a right leg support cutout, which is positioned on an upper front right part of the cushion, such that the right leg support cutout is configured to support, guide, and position a right leg of the user that is seated on the cushion; and defining a left leg support cutout, which is positioned on an upper front left part of the cushion, such that the left leg support cutout is configured with a shape, which is symmetrical with a shape of the right leg support cutout, with respect to a front to rear centerline of the cushion, such that the left leg support is configured to support, guide, and position a left leg of the user that is seated on the cushion;

wherein the right and left apertures are configured to reduce the pressure applied to respective right and left sitting bones of a user seated on the cushion, thereby providing relief from pressure and pain to the buttocks of the user;

wherein surfaces of the right and left leg support cutouts are each configured with a shape as an inner segment of an elliptic cylinder, whereby surface lines following an elongated direction of the elliptic cylinder are straight surface lines;

wherein the straight surface lines comprise right and left straight surface lines of respectively the right and left cutouts;

such that the right straight surface lines are configured with a right outward angle in a range of 1 to 45 degrees, relative to the centerline of the cushion; and such that the left straight surface lines are configured with a left outward angle in a range of 1 to 45 degrees, relative to the centerline of the cushion.

15. The method of configuring a support contour of a cushion of claim 14, wherein the right and left apertures are configured in the shape of an elongated ellipsoid, such that an elongated center axis of each of the right and left apertures is parallel to the front to rear centerline of the sitting bones cushion.

16. The method of configuring a support contour of a cushion of claim 14, wherein the upper surface is oriented at an inclination angle in a range of 1 to 45 degrees, relative to horizontal.

17. The method of configuring a support contour of a cushion of claim 14, wherein the cushion is further configured with a cushion cover.

18. The method of configuring a support contour of a cushion of claim 14, further comprising:

making a cutout in a rear area of the cushion, whereby a user experiences reduced pressure on a coccyx when seated in the cushion.

* * * * *